US008465346B1

(12) United States Patent
Cattaneo

(10) Patent No.: US 8,465,346 B1
(45) Date of Patent: Jun. 18, 2013

(54) SLIDABLE PLATFORM ABRASION WORKSTATION DEVICE FOR TRUING MODEL CAR WHEELS AND AXLES

(71) Applicant: Stephen Michael Cattaneo, Dublin, OH (US)

(72) Inventor: Stephen Michael Cattaneo, Dublin, OH (US)

( * ) Notice: Subject to any disclaimer, the term of this patent is extended or adjusted under 35 U.S.C. 154(b) by 0 days.

(21) Appl. No.: 13/669,558

(22) Filed: Nov. 6, 2012

(51) Int. Cl.
*B24B 23/02* (2006.01)

(52) U.S. Cl.
USPC ..... 451/386; 451/387; 451/398; 269/43; 269/901

(58) Field of Classification Search
USPC ..... 451/385, 386, 387, 397, 398; 269/43, 269/901, 156, 55, 71, 6
See application file for complete search history.

(56) References Cited

U.S. PATENT DOCUMENTS

| | | | | |
|---|---|---|---|---|
| 2,034,507 | A * | 3/1936 | Colson | 451/28 |
| 2,542,616 | A * | 2/1951 | Barrett | 408/62 |
| 2,605,591 | A * | 8/1952 | Hill | 451/258 |
| 3,007,290 | A * | 11/1961 | Davis et al. | 451/428 |
| 3,423,885 | A * | 1/1969 | Crandall | 451/387 |
| 3,598,017 | A * | 8/1971 | Saari | 409/165 |
| 7,243,582 | B1 * | 7/2007 | Launius | 82/104 |
| 7,811,154 | B2 * | 10/2010 | Ling et al. | 451/241 |
| 2007/0161336 | A1 * | 7/2007 | Yen | 451/28 |

OTHER PUBLICATIONS

Meade, D. All About Axles in Winning Wheels Wood Carving Illustrated Magazine. Supplemental Issue, Pinewood Derby Style Race Cars, copywrite 2012, Fox Chapel Publishing Co. Inc, E Petersburg, PA.

Thorne, T. Getting Started in Pinewood Derby, pp. 52-59, copywrite 2011, Fox Chapel Publishing Co. Inc, E. Petersburg, PA.

Thorne, T. Pinewood Derby Design and Patterns, pp. 78-81, copywrite 2007, Fox Chapel Publishing Co. Inc, E. Petersburg, PA .

Meade, D. Pinewood Derby Speed Secrets pp. 57-63, copywrite 2006, Fox Chapel Publishing Co. Inc, E. Petersburg, PA.

* cited by examiner

*Primary Examiner* — Maurina Rachuba
(74) *Attorney, Agent, or Firm* — Todd L. Juneau

(57) ABSTRACT

The device is a U-shaped housing comprising slidable platform embodiments providing defined and directed platform movements toward the task of shaping a rotating workpiece substantially at 90 degrees and 180 degrees to the axis of rotation. The device provides for sliding surface planes configured to accept abrasive materials and implements at predetermined angles for the purpose of trimming imperfections and truing model car wheels and axles. As an alternative to more complex machine shop equipment, the child, applying sandpaper to the platform surfaces and a triangular file or rectangular file on platform insets is enabled to effectively direct an abrasive surface which is configured at 90 degrees and 180 degrees to the axis of rotation for the purpose of truing the model car wheel and axle. To further enhance the child's participation, the workpieces can effectively be manually rotated in the slidable platform abrasion workstation device.

17 Claims, 13 Drawing Sheets

SLIDABLE PLATFORM ABRASION WORKSTATION DEVICE FOR TRUING MODEL CAR WHEELS AND AXLES

BACKGROUND

Each year over one million Cub Scouts in over 47,000 Cub Scout Packs participate in a very special event: The Pinewood Derby®. Initiated in 1953, the program adopted by The Boy Scouts of America® has become an enormous success. Cub Scouts who win local Den and Pack races move on to district finals. The popular event has expanded to other youth groups including the Girl Scouts. International programs have been established.

Children, 7 through 10 years of age, along with a parent or sponsor, create a race car from a block of wood, four axles and a set of plastic wheels. The Derby car, with the force of gravity, runs down an inclined track over a central guide rail to the finish line. Adhering to basic Pack rules and principles of design, weight distribution, wheel and axle preparation, and alignment, the Cub Scout along with his parent attempts to build a winning car.

The emphasis in this team effort is to promote the parent/child relationship and to provide a learning experience with the active participation of the Cub Scout. Techniques to reduce wheel and axle friction, the enemy of speed, often involve power tools and machine shop equipment including a drill press or machine shop lathe which the Cub Scout cannot safely use. This truing of the wheels and axles is an important objective in building the race car. It has been recognized as the single most important principle to attaining optimal derby car speed.

Structure defines function and function defines performance. Structural defects produced during the manufacture of derby car wheels and axles have been well described. The plastic wheels are generally manufactured using a mold injection process that can lead to defects in the wheel circumference, wheel tread, central axle hole and hub. The wheel may not be round to the central axle hole. It may have uneven treads containing divots and inner wheel sidewall rim profiles that are irregular. Under these conditions friction is increased as the rotating wheel hobbles, vibrates, veers and rubs against the guide rail. Moreover, wheel axle manufacturing imperfections contributing to friction include so-called gussets inside the head surface and burrs on the axle shaft.

There has been a longstanding need for a device which would enable a child to remove imperfections in a way that, ideally, reduces vibration and friction by providing interactive wheel and axle surfaces that are horizontal or perpendicular to the axis of rotation. A flat wheel tread horizontal to the axis of rotation provides for a wheel central axle hole rotating horizontal to axle alignment and a flat tread configuration on the race track that minimizes friction. The horizontal tread configuration reduces outer and inner rim circumference size discrepancies which, if present, can transmit frictional torque forces to the wheel central axle hole on axle interface. Wheels of different diameter can transmit frictional torque forces to the wheel central axle hole, axle interface. The inner rim sidewall, if not revolving throughout its entire circumference in a plane perpendicular to the axis of rotation, could cause a wheel in contact with the rail guide to oscillate on the axle.

A structured workstation device was conceived to address these concerns and the need to enable Cub Scout participation in the preparation and the truing of wheels and axles. Emphasis in its design was to provide a unique opportunity for the Cub Scout to create:

a. four wheels uniformly round to the central axle hole.
b. four wheels with identical diameter and circumference.
c. wheel treads flat and horizontal to the axis of rotation.
d. wheel inner sidewall rims with flat profiles at 90 degrees to the axle throughout a complete rotation of the inner sidewall of the wheel.
e. an axle head free of defects with the inner surface at 90 degrees to the axle shaft throughout the complete circumference of the axle head.
f. an axle shaft free of burrs, horizontal to the axis of rotation.

The device provides for slidable platform embodiments with predetermined planes to which abrasive materials and implements can be applied, directing a mechanical energy toward the task of truing model car wheels and axles at 90 degrees and 180 degrees to the axis of rotation. For the Cub Scout who does not have access to complex machine shop equipment, it equals the playing field. Moreover, the workstation embodiment has been reduced to practice. A prototype has been built, tested and has performed with accuracy. The marketing potential is formidable.

DESCRIPTION OF THE PRIOR ART

Traditionally, derby car wheels and axles are prepared by removing manufacturing imperfections leaving surfaces that are smooth and polished. These imperfections include a wheel that is not perfectly round and a wheel central axle hole that is not directly in the center of the wheel. These defects cause the wheel to bounce or hobble as it rotates, increasing friction as the wheel travels down the track. The inner wheel sidewall rim may have minute surface irregularities which can cause the wheel to oscillate should the inner rim ride against the track guide rail.

Wheel tread imperfections from the stock mold may include slight divots, bubbles, protrusions or other irregularities that produce vibration and wheel chatter on the axle. The prior art to round the wheel and trim the tread provides for the use of a wheel mandrel to which a single wheel has been mounted. The mandrel is then mounted in the chuck of a hand drill that is secured in a bench vice or the chuck of a hand held Dremel tool. The drill or Dremel is turned on and, with the guidance of an adult, a sheet of moistened sandpaper secured to a block of wood is pressed against the rotating wheel tread. Finer grits of sandpaper are applied to round the wheel and smooth the tread. The hand held sandpaper surface if held in a profile that is not horizontal to the axis of wheel rotation can compromise the wheel tread. This produces discrepancies in the outer and inner rim diameters of the tread.

I have found that even minute differences in tread rim size can cause the rolling wheel to veer. For example, an outer wheel rim larger than an inner wheel rim will produce a tendency for the wheel to turn in as the larger outer rim of the tread tends to travel further on a single rotation. Momentum may deter the racing car from veering, but the rim discrepancy forces are transmitted back to the wheel central axle hole and axle as the wheel tread tends to flatten on the track. These forces increase friction.

Moreover, with the above prior art methodology the wheels are prepared individually. Wheel diameters and tread profiles may not be uniform. The inner wheel sidewall rim is sanded with the wheel rotating on a mandrel using progressively finer grits of sandpaper. Again, this is performed in a hand held maneuver with attention to Cub Scout Pack rules which prohibit narrowing of the wheel tread.

In similar fashion, the wheel axle is mounted in the chuck of a hand drill secured in a bench vice or in the chuck of a hand held Dremel tool. With the drill or Dremel turned on, a hand held triangular file is cautiously held against the inner surface defect of the axle head, with care, to keep a file surface perpendicular to the axis of rotation. This needs to be accomplished without filing into the adjacent axle shaft. This is no easy task for the child using the hand held file with no structural support to the hand or fingers.

For the parent/son team with access to a drill press the wheel can be mounted by positioning and securing the drill chuck inside the inner sidewall rim, protecting the hub. The wheel is horizontal to the drill press table. The drill press is turned on and a strip of sandpaper is held against the rotating wheel tread which is rotating perpendicular to the drill press table. Cub Scout participation, with concern for safety, is limited in this drill press application. Moreover, if the sandpaper surface is hand held in a profile which is not perpendicular to the horizontal axis of wheel rotation the wheel tread is compromised such that it is not horizontal to the axis of rotation. This leads to differences in the inner and outer wheel tread rim diameters producing the rim discrepancy forces described above.

Similarly, the wheel axle can be prepared using the drill press. The wheel axle is mounted vertically in the chuck. With the drill press turned on a triangular file is hand held on the inner surface of the rotating axle head to remove defects. Again, care must be taken in this hand held technique to keep the file flat on the inner surface of the axle head, perpendicular to the axis of axle head rotation. This needs to be accomplished without filing a groove in the adjacent axle shaft. An additional prior art technique is to place and hold a triangular file on the drill press table. With the head of the axle in the chuck below the central opening in the table the chuck is slowly raised causing the inner surface of the axle head to meet the hand held triangular file positioned on the drill press table at 90 degrees to the axis of rotation. Again, precautions are needed to avoid filing into the adjacent axle shaft. With concerns for safety, there is usually limited Cub Scout participation in this fine tuning application.

A machine lathe can true the wheels and axles to perfection, providing wheel and axle surfaces that are horizontal or perpendicular to the axis of rotation. The wheel runs straight and true with optimally reduced sources of friction. Access to this prior art is generally limited, however. With concerns for safety, there is no Cub Scout participation using large machine lathes in the fine tuning of wheels and axles. The procedure is performed by the adult or a machine lathe professional.

The U.S. Pat. No. 7,243,582 discloses a manual lathe which can be used to round a wheel perimeter and square the wheel rim. A wheel, mounted on a hub tool or spindle, is turned by hand against a blade which is advanced incrementally in a predetermined direction. The configuration of the blade cutting edge is transferred to the perimeter of the rotated wheel. The configuration and condition of the blade cutting edge needs to be monitored for the child. Moreover, the manual lathe does not provide for the simultaneous preparation of a plurality of wheels with similar wheel diameter.

The above device is a lathe which manually utilizes a metal cutting tool to fulfill the particular objectives described. The slidable platform abrasion workstation device to be described in detail provides a different embodiment which does not utilize a blade.

Prior art for the preparation of wheels and axles in Derby car competition with the application of mandrels, hand drills or Dremel tools functions to fulfill basic objectives for the Cub Scout learning experience. Potential limitations, however, to this methodology have been described above. Moreover, prior art involving large power tools do not enable the Cub Scout to effectively participate in the fine tuning of the wheels and axles for his derby car.

The slidable platform abrasion workstation device satisfies a longstanding need to provide a mechanism using the traditional Cub Scout sandpaper and file techniques to remove imperfections at controlled, predefined angles to the axis of rotation of derby car wheels and axles. This fine tuning reduces friction, enhancing the speed of the race car.

The device provides for predetermined abrasive platform surface planes, which for the purpose of truing the model car wheel and axle, are configured substantially at 90 degrees and 180 degrees to the axis of rotation. It further enables the Cub Scout to actively participate in the preparation of his derby car wheels and axles, utilizing a fine tuning device which has performed with accuracy in prototype format.

The advantages over prior art for one or more aspects of the embodiment will become apparent from a consideration of the ensuing description and accompanying diagrams.

SUMMARY

The slidable platform abrasion work station device is basically a symmetrically structured slidable platform device that provides a moving surface to which abrasive materials or implements can be applied to the task of trimming and shaping horizontally positioned workpieces, including model car wheels and axles. In essence, the device is novel in that it provides a supportive structure to the traditional Cub Scout sandpaper and file techniques used to remove manufacturing defects from derby car wheels and axles.

The device is characterized by one or more slidable abrasive planes which can be moved in directed motions which are horizontal and perpendicular to the axis of rotation of the rotating wheel or axle. The structured platform configuration provides for the truing of model car wheels and axles. Wheel treads are substantially horizontal to the axis of rotation and side walls are uniformly perpendicular to the axis of rotation throughout a complete rotation of the wheel.

In similar fashion, the device provides for the positioning and shaping of the inner surface of the axle head perpendicular to the axis of rotation and the adjacent axle shaft horizontal to the axis of rotation.

The device is further characterized by a bilateral mounting of a wheel axle rod providing a fixed axial rotation between two supportive columns. A plurality of wheels can be trimmed and trued simultaneously to provide substantially identical wheel tread surface profiles and wheel diameters. Some Cub Scout packs are promoting a scout/parent workshop experience to prepare and create the derby car three hours before a derby car race, a concept which facilitates the use of the work station device to prepare wheel and axles in a timely manner.

Access to prior art techniques utilizing machine shop tools such as a drill press or machine lathe may be limited. When utilized, lacking the skills and in the interest of safety, Cub Scout participation is limited. In this circumstance, the parent, sponsor or machine shop specialist is principally involved in the shaping and truing of the derby car wheels.

The slidable abrasive platform device is safe for use by a child. There are no blades. It can be utilized manually or with a hand drill. It provides a means for the child to remove manufacturing imperfections, trimming and polishing wheels and axles to predetermined configurations to reduce friction. It utilizes traditional sandpaper and standard mill file resources. A working model has performed with accuracy to the extent it evens the playing field for those Cub Scouts who do not have access to machine shop equipment. It is cost effective. The marketing potential is formidable.

DESCRIPTION OF PREFERRED EMBODIMENT

Figure 1:
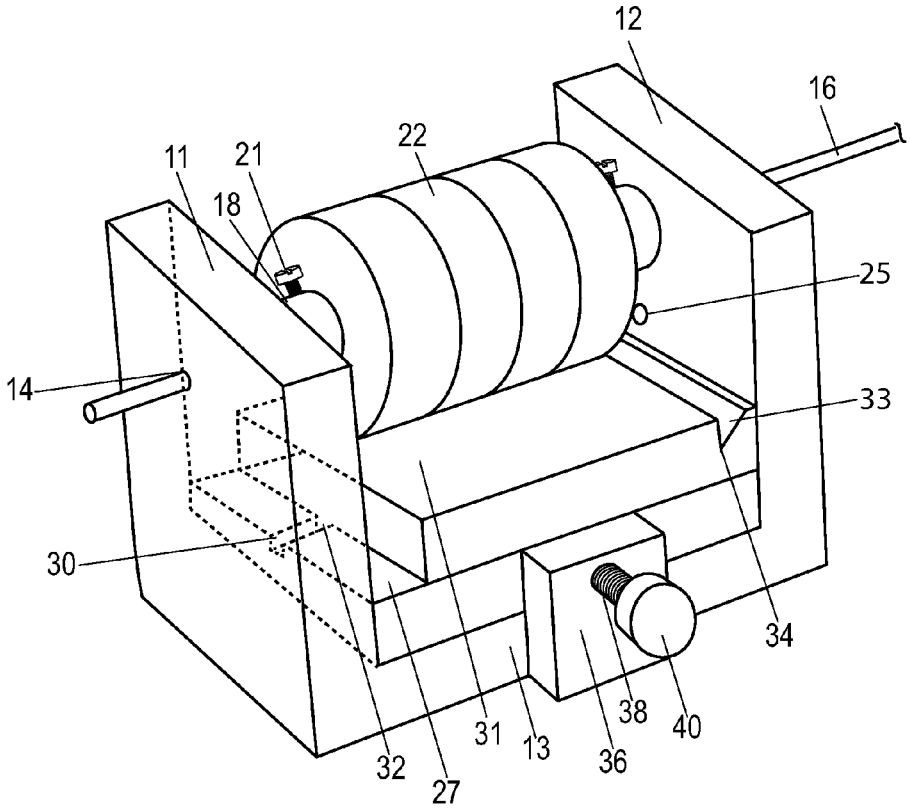
FIG. 1 shows an overall frontal perspective view of a presently preferred embodiment of a slidable platform abrasion workstation device.

FIG. 1 shows an overall frontal perspective view of a presently preferred embodiment of a slidable platform abrasion workstation device. It is a workstation which can be utilized by a Cub Scout to remove manufacturing imperfections and true model car wheels and axles.

Figure 2:
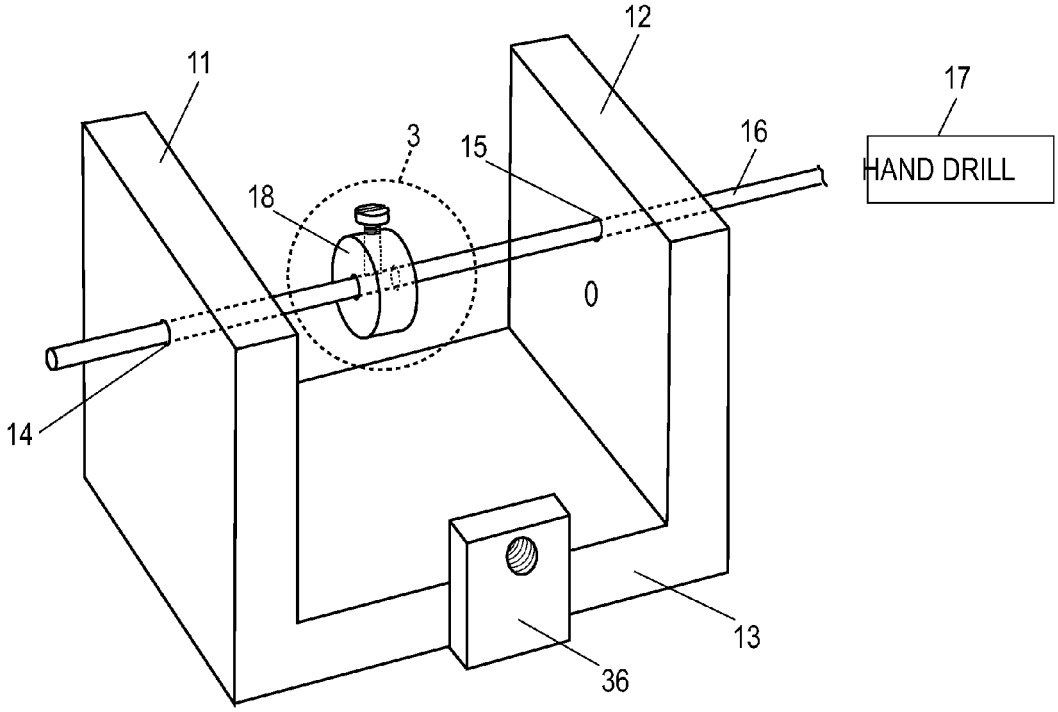
FIG. 2 shows a perspective view of the basic U-shaped housing frame for the device with a workpiece anchor and wheel axle rod. The anchor machine screw threads are not shown for clarity.

Shown in FIG. 2, is the basic frame for the device, a U-shaped housing consisting of a rectangular left column 11, generally 50 mm in width, 45 mm in height and 10 mm in thickness and a similarly configured right column 12. The left column is mounted to the left side of a rectangular base platform 13, generally 80 mm in length, 50 mm in width and 10 mm in thickness. The right column 12 is mounted to the right side of the base platform 13. This structure forms a U-shaped housing for the slidable platform embodiments to be described.

The left column 11 has a hole 14 of predetermined size in its upper mid portion perpendicular to the vertical plane of column 11 and horizontal to the base platform 13. The right column 12 has a similar hole 15 in similar configuration. This provides for symmetrical bilateral mounting of a wheel axle rod 16 of predetermined size across the upper portion of the housing horizontal to the longitudinal plane of the base platform 13. The wheel axle rod 16 extends through hole 14 generally to a length of 20 mm to the left of column 11 and through hole 15 generally to a length of 40 mm to the right of column 12. This extension of the wheel axle rod 16 to the right of column 12 provides access to the chuck of a hand drill 17 for the rotation of the wheel axle rod 16.

Figure 3:
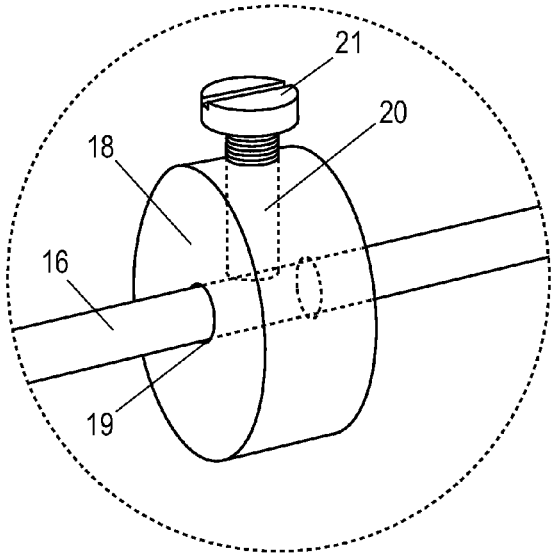
FIG. 3 is an enlarged, perspective-view of a cylindrical wheel anchor. Anchor machine screw threads are not shown for clarity.

FIG. 3 demonstrates a cylindrical wheel anchor 18, generally 10 mm in diameter and 8 mm thick with a central axial hole 19 of predetermined size. A threaded hole 20 of predetermined size, generally 3 mm in diameter, extends from the outer rim of the wheel anchor 18 perpendicular to and in to the central axial hole 19. This provides access for a threaded machine screw 21 which, when rotated in clockwise direction, is used to secure the wheel anchor 18 to the wheel axle rod 16.

Figure 4A:
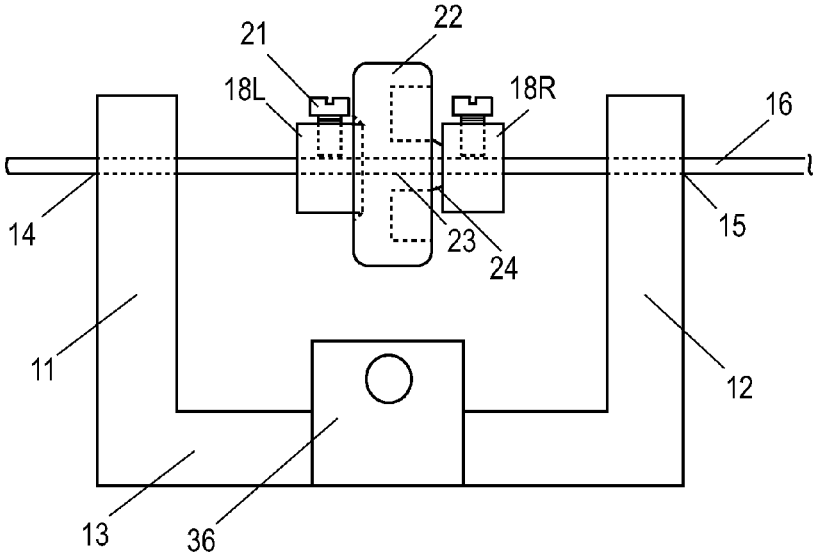
FIG. 4A shows a frontal view of the workstation device with a wheel secured between two anchors on the wheel axle rod.
Figure 4B:
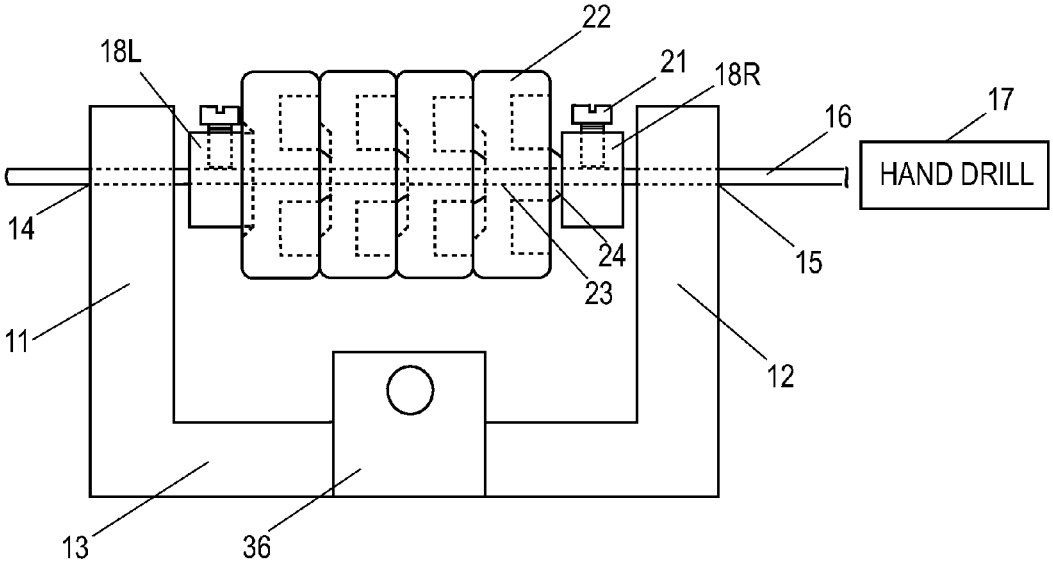
FIG. 4B shows a plurality of wheels mounted on the wheel axle rod as a single workpiece.

As demonstrated in FIG. 4A, a wheel 22 is shown mounted on the wheel axle rod 16 by sliding the wheel axle rod 16 through the wheel central axle hole 23 with the wheel hub 24 positioned to the right toward column 12. A left wheel anchor 18L is positioned on the wheel axle rod 16 to the left of a wheel 22 and secured by tightening the machine screw 21. A second anchor, 18R, is positioned on the wheel axle rod 16 and secured to the right of wheel 22. FIG. 4B shows the wheel 22 mounted in plurality, compressed on the wheel axle rod 16 between an anchor 18L and an anchor 18R so that they rotate as a single workpiece on the wheel axle rod 16. This configuration provides a plurality of wheels prepared to be trimmed and shaped to substantially identical diameters, circumferences and wheel tread profiles as the wheel axle rod 16 is rotated with the urging of a hand drill 17.

Figure 5A:
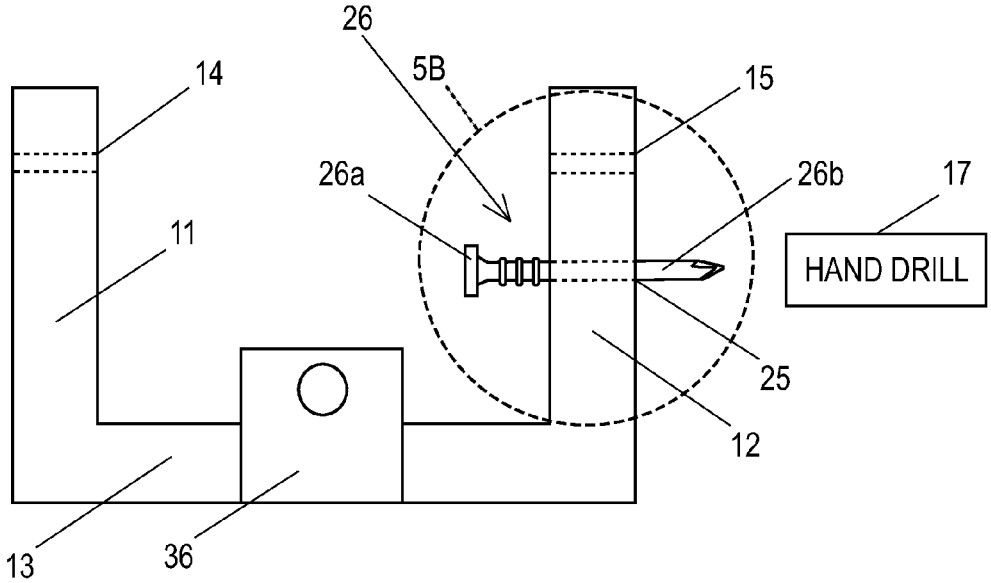
FIG. 5A shows a frontal view of the U-shaped housing of the workstation device with a wheel axle mounted in the right column.

Turning to FIG. 5A, the right column 12 has a second hole 25 of predetermined size perpendicular to the vertical plane of column 12 and horizontal to the base platform 13 to accept the axle shaft 26*b* of a model car wheel axle 26 such that the axle head 26*a* of the wheel axle 26 is inside the column 12. The extension of the axle shaft 26*b* to the right of column 12 provides access to the chuck of a hand drill 17 for the rotation of the wheel axle 26. The wheel axle 26, with the urging of the hand drill, is thus rotated in the U-shaped housing perpendicular to the inner face of column 12 and horizontal to the base platform 13.

Figure 5B:
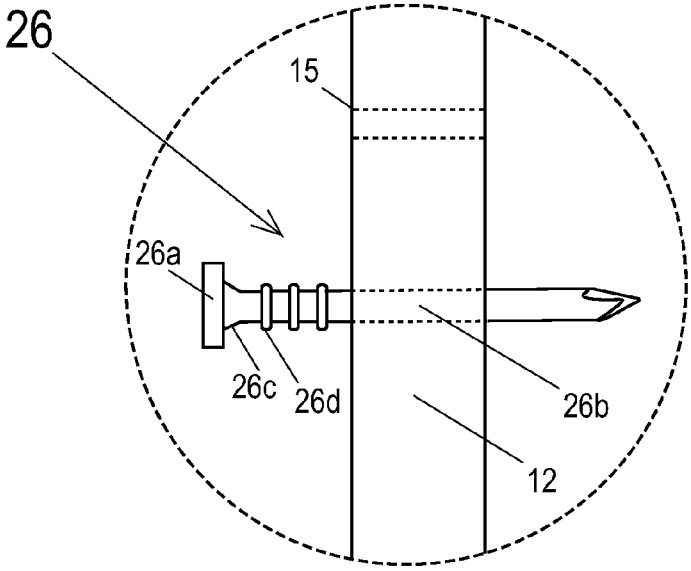
FIG. 5B is an enlarged view of the components of a wheel axle.

FIG. 5B demonstrates the components of the wheel axle 26 which includes imperfections, so-called gussets 26*c*, inside the axle head 26*a*, and shaft burrs 26*d* on the axle shaft 26*b*.

The following is a description of the slidable platform embodiments of the slidable platform abrasion workstation device, FIG. 1, to which abrasive materials or implements are applied horizontal and perpendicular to the workpieces previously described as the wheel 22 and the wheel axle 26.

Figure 6A:
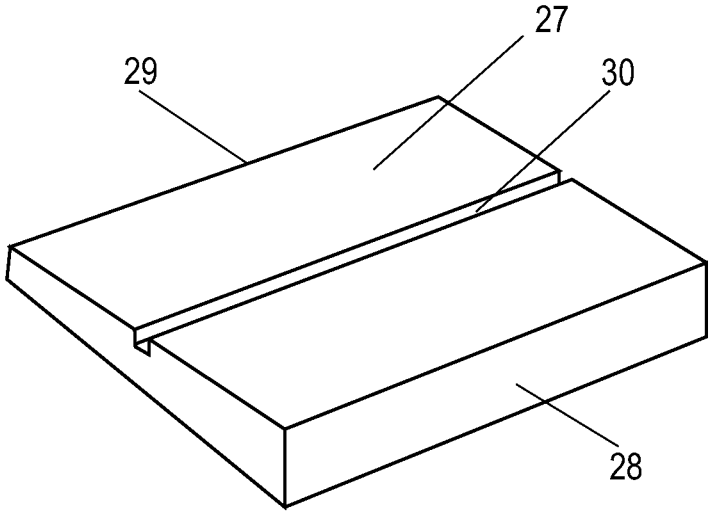
FIG. 6A shows a perspective view of the presently preferred embodiment of a slidable wedge-shaped lower platform.

In FIG. 6A, the presently preferred embodiment of the slidable lower platform 27 is shown. The lower platform 27 is rectangular, wedge-shaped and generally 60 mm in length and 50 mm in width. The wedge shape is provided by sloping the upper surface with the front face 28 of the lower platform 27 being generally 10 mm thick and the back face 29 being generally 5 mm thick.

A transverse groove 30, generally 2 mm depth and 2 mm width, extends right to left, longitudinally across the mid surface of the sloped upper surface of the lower platform 27. It is parallel to the front face 28 of the lower platform 27.

Figure 6B:
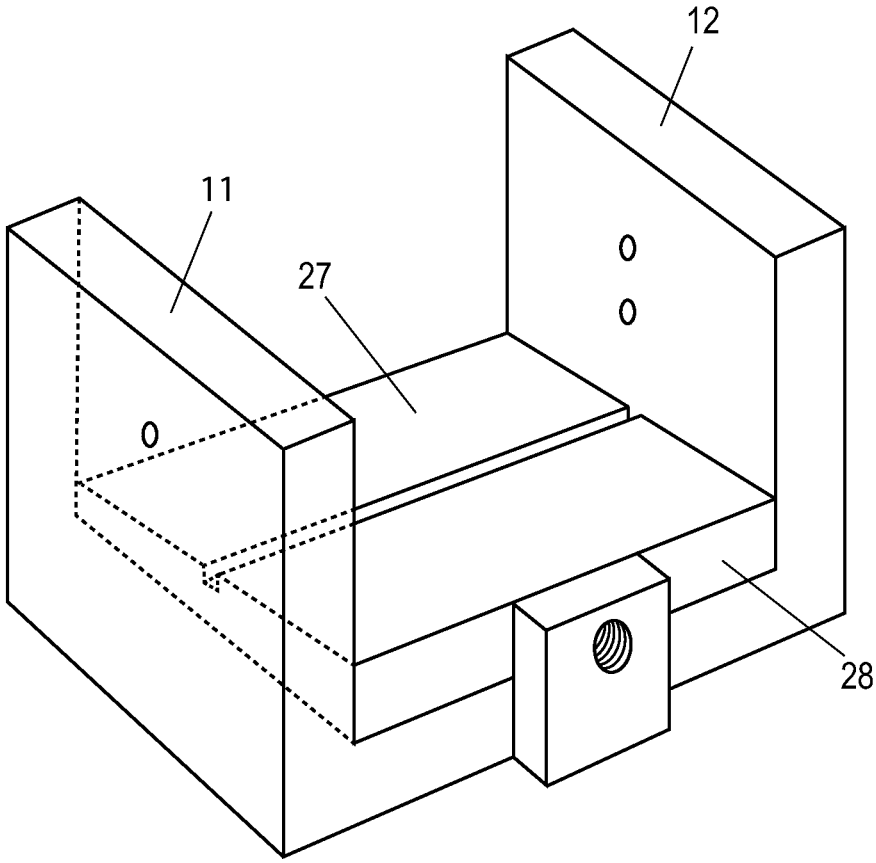
FIG. 6B is a perspective view of the lower platform positioned between the columns of the workstation device.

As shown in FIG. 6B, the lower platform 27 is slidably mounted in the housing between column 11 and column 12. This slidable, wedge-shaped embodiment provides simultaneous forward motion and an upward vertical motion of the top sloped surface as the lower platform 27 is advanced.

Figure 7A:
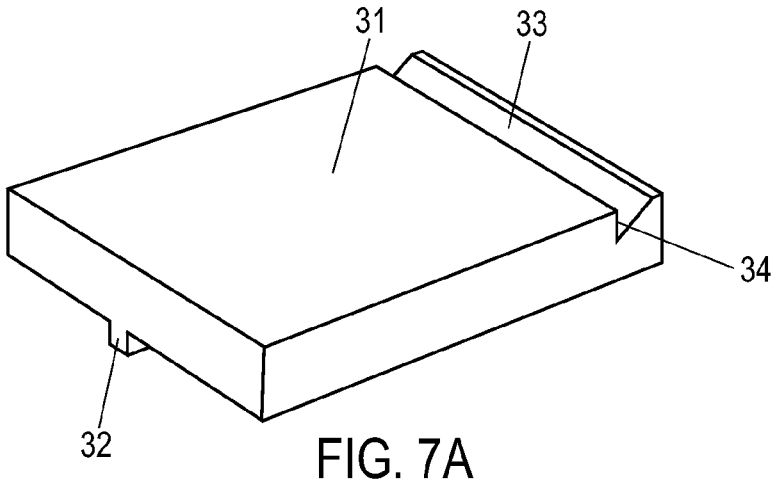
FIG. 7A shows a perspective view of the presently preferred embodiment of a slidable upper platform.

In FIG. 7A, the presently preferred embodiment of the slidable upper platform 31 is shown. The upper platform 31 is planar, rectangular, and generally 55 mm in length, 50 mm in width and 10 mm in thickness. A slide bar 32 extends transversely along the under surface of the upper platform 31. It is generally 2 mm in depth and 2 mm thickness, placed and configured to slide and traverse the groove 30 in the lower platform 27 to provide a longitudinal motion of the upper platform 31, right to left.

The upper platform 31 has a longitudinal 60 degree wedge-shaped groove 33, front to back, along the right edge of the top surface, with the top width of the groove, generally 5 mm. The groove is configured to run parallel to and generally 2 mm from the right edge of the upper platform 31 at a depth of generally 4 mm. The inner face 34 of the 60 degree wedge-shaped groove 33 is perpendicular to the top surface of the upper platform 31.

Figure 7B:
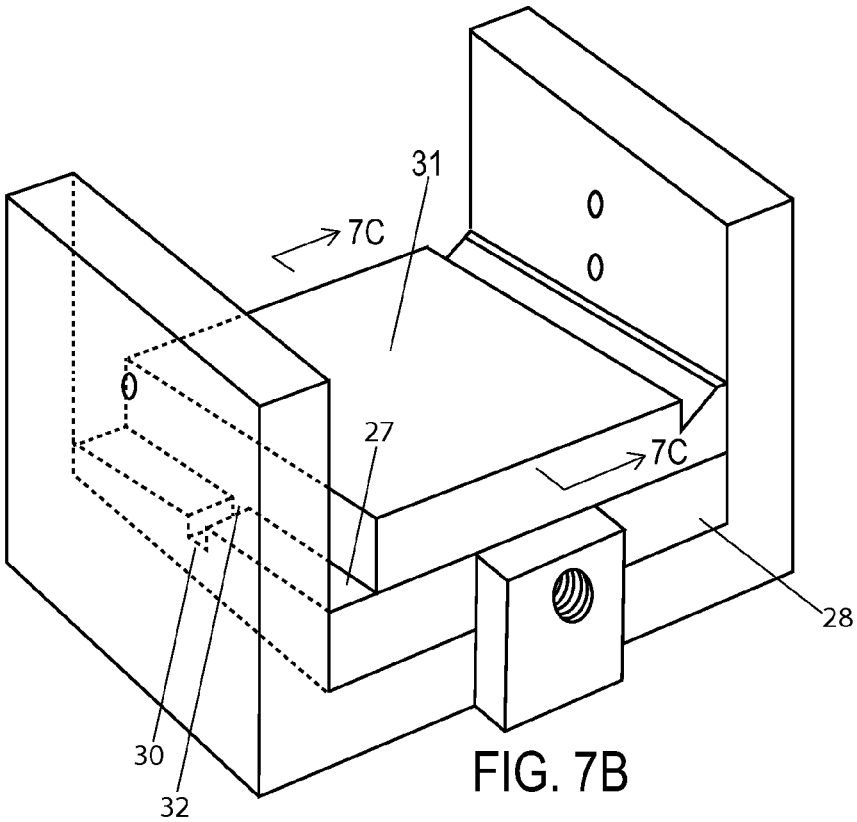
FIG. 7B is a perspective view of the upper slidable platform mounted on the lower slidable platform and positioned between the columns of the workstation device.

Turning to FIG. 7B, the upper platform 31 and the lower platform 27 are of the same width, generally 50 mm. The upper platform 31 is mounted on the lower platform 27 by placing the slide bar 32 of the upper platform 31 in the groove 30 of the lower platform 27 to provide a simultaneous, contiguous movement of both platforms front to back.

Figure 7C:
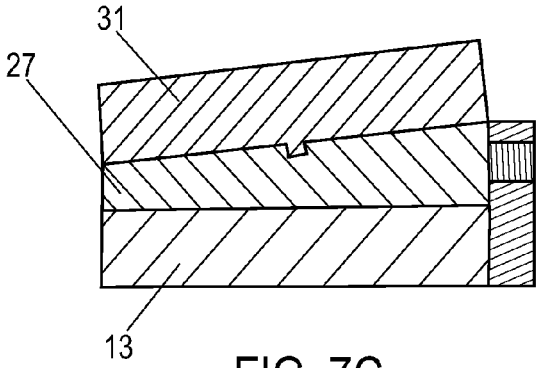
FIG. 7C shows is a sectional side view of the wedge-shaped lower platform set between base platform and the sloping planar upper platform.

As seen in a sectional view, FIG. 7C, the sloped upper surface of the wedge-shaped lower platform 27 provides for a similar degree of sloping of the top surface of the planar upper platform 31.

Figure 7D:
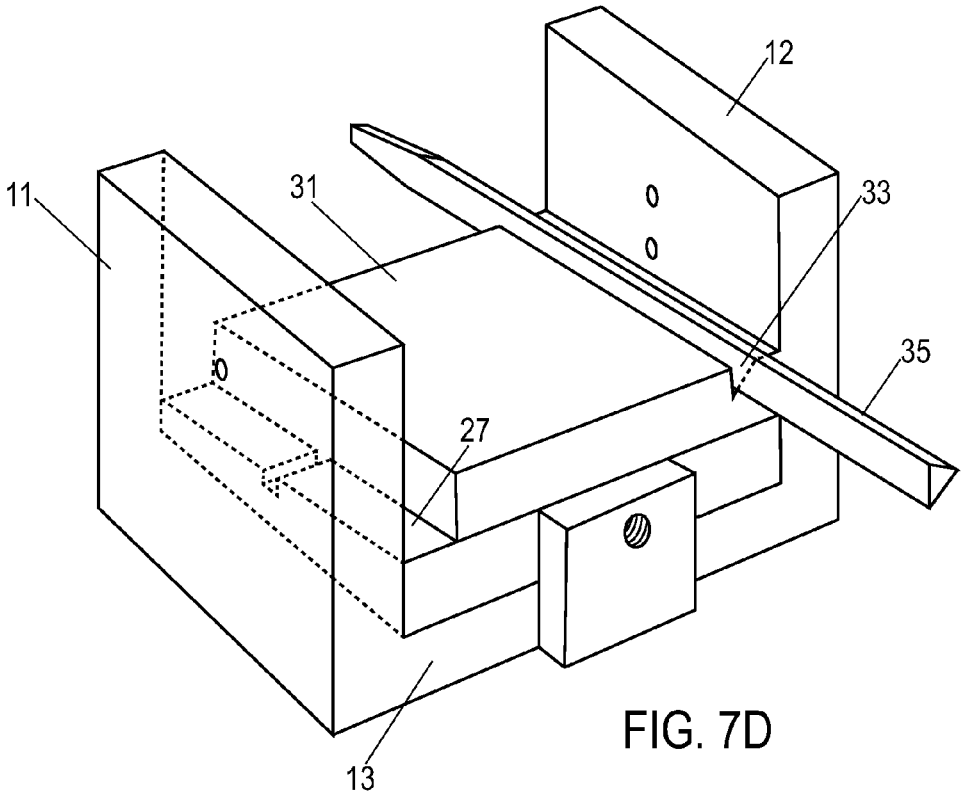
FIG. 7D is a perspective view of the assembled workstation device with a triangular mill file positioned in the 60 degree groove.

FIG. 7D, in perspective view, shows the slidable platform abrasive workstation device, FIG. 1, with an abrasive triangular implement positioned in the 60 degree wedge-shaped groove 33 at 90 degrees to the surface of the upper platform 31. This abrasive implement, as shown, is a standard triangular mill file 35. The three surfaces of the standard triangular file 35 are generally 8 mm in width at 60 degree angles.

Figure 8A:
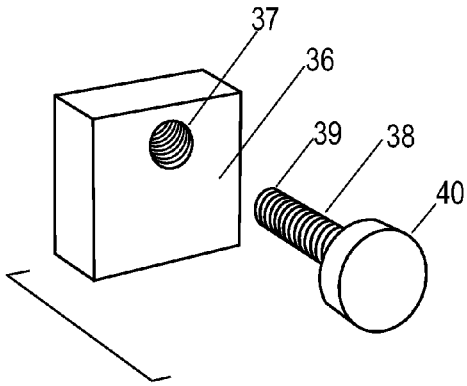
FIG. 8A shows the components of a mechanism for incremental advancement of the contiguously mounted platforms.

FIG. 8A shows a mechanism for incremental advancement of the lower platform 27 comprised of a face plate 36, generally 20 mm square with a thickness of 5 mm. The face plate 36 has a threaded hole 37 of predetermined size, positioned with the center of the threaded hole 37 at a position 5 mm below the top center of the face plate 36 to accept a threaded rod 38. The threaded rod 38 is comprised of a blunt end 39 and an opposite end with a control knob 40.

Figure 8B:
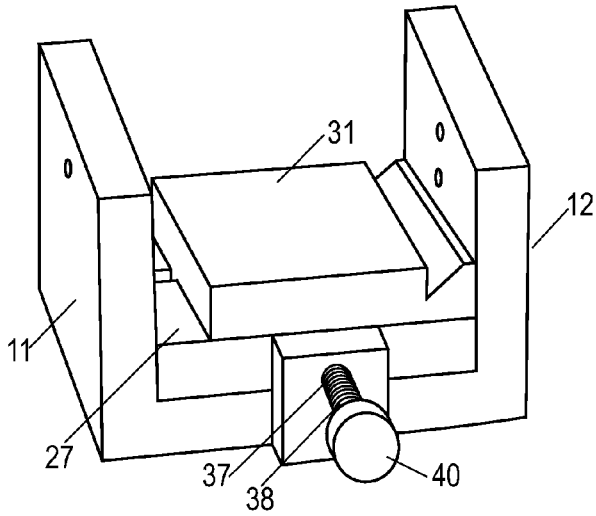
FIG. 8B is a perspective view of assembled components of the workstation device.

FIG. 8B is a perspective view of the slidable platform abrasion workstation, FIG. 1 showing the placement of the mechanism described above. Clockwise rotation of the control knob 40 of the threaded rod 38 within the threaded hole 37 provides for an incremental advancement of the lower platform 27 between column 11 and column 12. The upper platform 31, contiguous with the lower platform 27, therefore also moves forward in this incremental manner as the control knob 40 is turned as shown in the sectional views, FIGS. 8C-D.

Figure 8C:
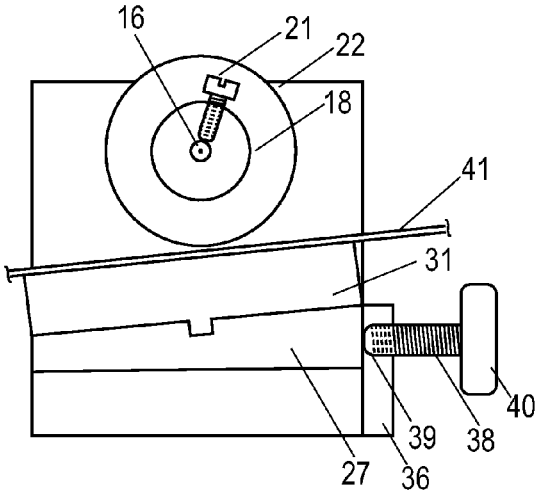
FIG. 8C is a right side view of the workstation with the right column removed demonstrating a wheel anchored as a workpiece on the wheel axle rod with sandpaper applied to the top surface of the upper platform.
Figure 8D:
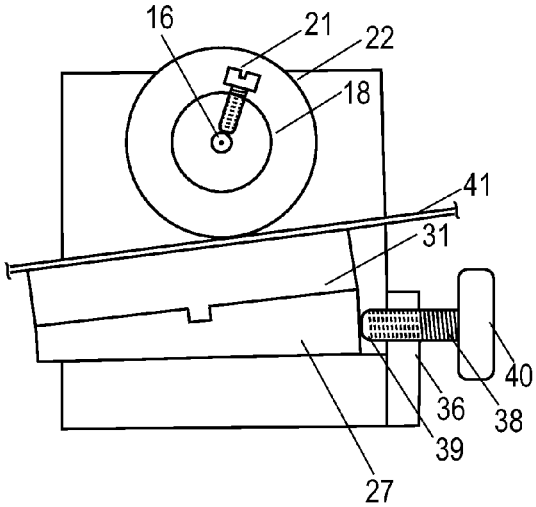
FIG. 8D is a right side view with the right column removed showing the sandpaper engaging the wheels as the platforms are advanced with the control knob.

A flat abrasive material applied to the top surface of the upper platform 31 permits incremental controlled abrasion of the rotating wheel 22 tread. Typically a sheet of sandpaper 41, FIGS. 8C-D, is utilized to trim the wheel 22 tread. A plurality of wheels anchored to the wheel axle rod 16, FIG. 1, and rotated against the sheet of sandpaper 41 placed on the slidable upper platform 31 uniquely provides for a plurality of wheels with substantially identical diameters, circumferences and wheel tread profiles.

Figure 9A:
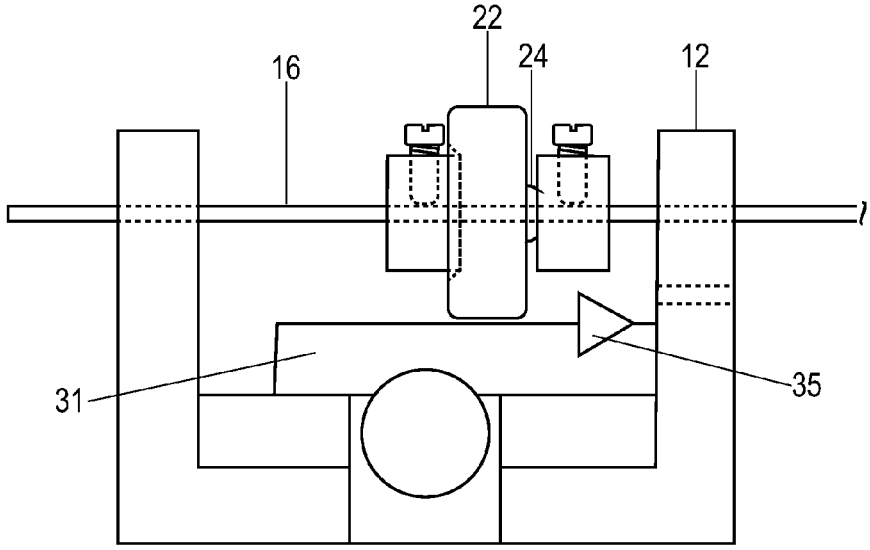
FIG. 9A shows a frontal view of the workstation device with an anchored wheel and a triangular mill file positioned in the groove of the upper platform at 90 degrees to the axis of wheel rotation.
Figure 9B:
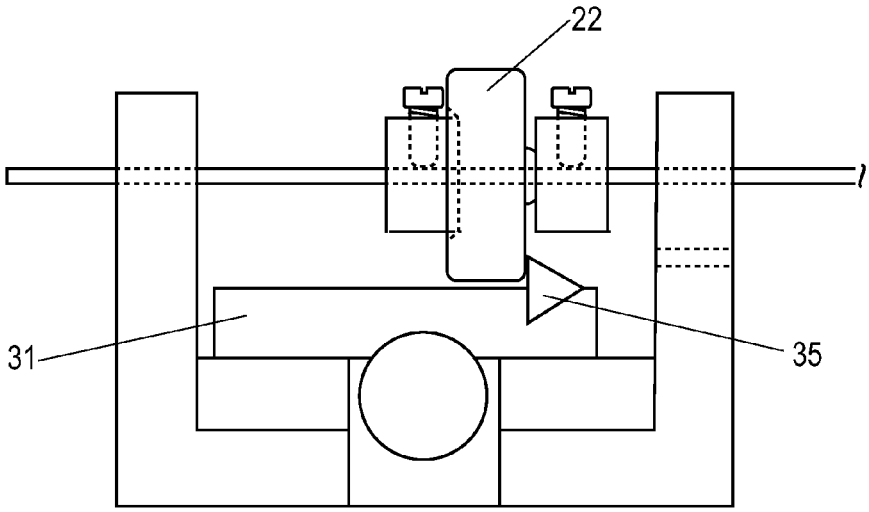
FIG. 9B is a frontal view of the workstation showing the triangular mill file engaging the inner wheel rim as the upper platform is moved to the left.

FIG. 9A shows the inner sidewall rim of a wheel 22 which is anchored on the wheel axle rod 16 with the wheel hub 24 facing column 12 in position for the inner sidewall rim of a wheel 22 to be trimmed by the triangular file 35 at 90 degrees to the axis of rotation of the wheel 22. The slidable upper platform 31 moved to the left demonstrates the file 35 engaging the inner sidewall rim of the wheel 22 to true the wheel rim, FIG. 9B.

Figure 10A:
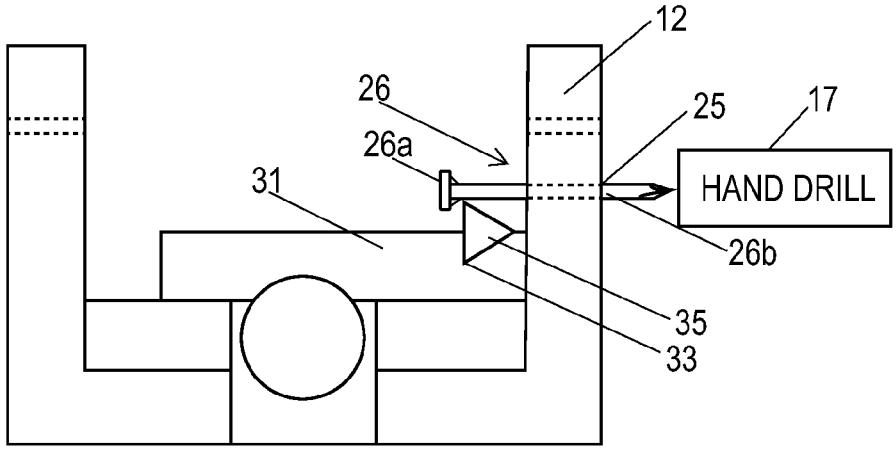
FIG. 10A shows a frontal view of the workstation device with a wheel axle mounted in the right column and a triangular mill file in the groove of the upper platform at 90 degrees to the wheel axle, parallel to the inner surface of the wheel axle head.
Figure 10B:
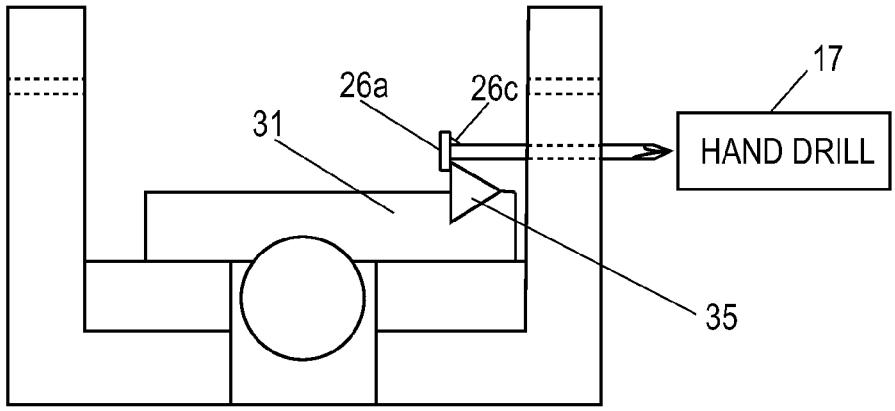
FIG. 10B is a frontal view of the workstation showing the mill file engaging the inner surface of the wheel axle head as the upper platform is moved to the left.

FIG. 10A shows the axle head 26*a* and the axle shaft 26*b* of the wheel axle 26 mounted in column 12 through hole 25 with the axle head 26*a* to the left of column 12 and the axle shaft 26*b* mounted in the chuck of the hand drill 17. The triangular file 35 is depicted in the 60 degree groove 33 of the upper platform 31 engaging the axle shaft 26*b* after incremental advancement of the upper platform 31. The upper platform 31, moved to the left as shown in FIG. 10B, depicts the file 35 engaging the inner surface of the axle head 26*a*. This contact with the rotating inner surface of the axle head 26*a* removes the gusset 26*c*, a manufacturing imperfection.

Figure 10C:
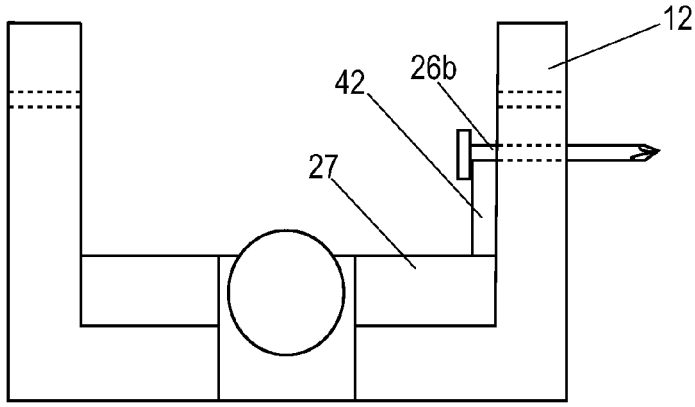
FIG. 10C shows a frontal view of the workstation device with the upper platform removed and a rectangular mill file positioned on the lower platform beneath the mounted wheel axle shaft.
Figure 10D:
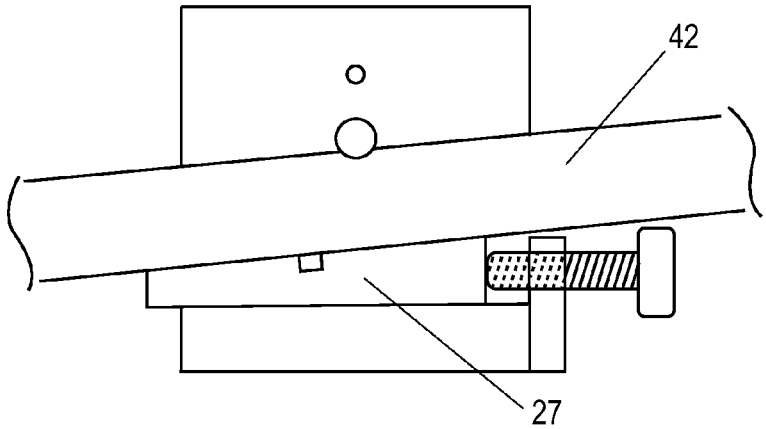
FIG. 10D is a right side view with the right column removed showing the rectangular mill file engaging the wheel axle shaft as the platform is advanced with the control knob.

In similar fashion, with the upper platform 31 removed, the sloped lower platform 27 is depicted, FIG. 10C, with a standard rectangular mill file 42. A standard rectangular mill file 42, generally 15 mm wide and 3 mm thick, is positioned in an upright position on the wedge shaped lower platform 27 against the right column 12. In FIG. 10D, the lower platform 27 is depicted in the advanced position with the rectangular file 42 engaged to remove, as shown in FIG. 5B, the burrs 26*d*, from the wheel axle shaft 26*b* of the wheel axle 26.

At present I believe that the embodiment, FIG. 1, as described operates most efficiently, permitting a child under the guidance of a parent or sponsor to remove wheel and axle imperfections. Using this workshop device the Cub Scout can actively participate in truing Pinewood Derby car wheels and wheel axles such that the trimmed wheel and axle surfaces are trued, substantially at 90 degrees or horizontal to the axis of rotation. This is important to minimizing the forces of friction.

Figure 11A:
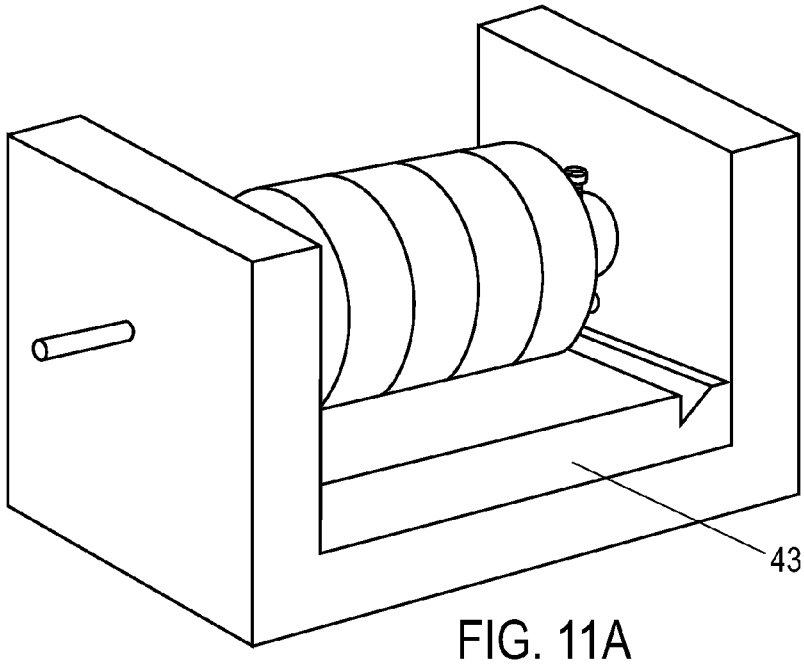
FIG. 11A is a perspective view of an alternative workstation embodiment showing a single slidable wedge-shaped platform with wheels mounted in plurality as a single workpiece.

An alternative embodiment, FIG. 11A, potentially lowering manufacturing cost for commercial implementation, is considered which is comprised of a single slidable platform 43 generally with the dimensions previously described. The single platform 43 combines the inclined surface of the lower wedge shaped platform 27 with the 60 degree groove configuration of the upper platform 31 to accept the triangular file 35. This provides a slidable wedge-shaped single platform 43 which slides in controlled contour between the columns. It is comprised of a top longitudinal surface which is horizontal to the wheel axle rod 16 and horizontal to the axle shaft 26*b* of the wheel axle 26. Accordingly, the hole 14 in the left column 11 and the hole 15 in the right column 12, previously described to accept the wheel axle rod 16, is lowered to a predetermined height maintaining the wheel axle rod 16 longitudinally horizontal to the top surface of platform 43. A sheet of sandpaper 41 applied to the entire upper surface of the sloped platform 43 provides, as previously described, for incremental abrasion of the wheel 22 treads for a plurality of wheels in a plane horizontal to the axis of rotation.

In this alternate embodiment the face plate 36 with the threaded rod 38 has been removed. The forward incremental movement of the single wedge shaped platform 43 is provided by manually advancing the single platform 43 between the columns.

Figure 11B:
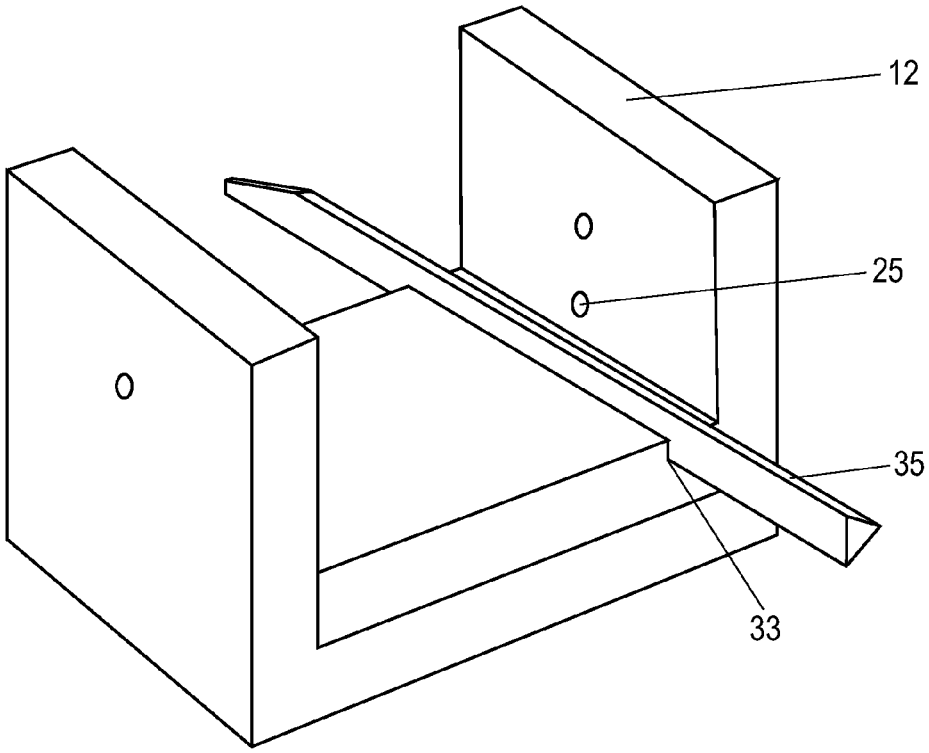
FIG. 11B shows the alternative embodiment with a triangular mill file positioned on the single platform at 90 degrees to the axis of workpiece rotation.

FIG. 11B shows the second hole 25 in column 12 lowered to a predetermined height for the truing of the wheel axle 26. A triangular file 35, positioned in the 60 degree wedge-shaped groove 33, provides for wheel 22 sidewall rim and axle head 26*a* abrasion at 90 degrees to the axis of rotation of the workpieces.

In this alternative embodiment the lateral motion which was provided by the slidable upper platform 31 in the original embodiment, FIG. 1, is now provided by symmetrically moving the entire workstation with its housing to the left, sliding it on the wheel axle rod 16 or on the axle shaft 26*b* of the wheel axle 26 away from the previously positioned hand drill 17. In this way a triangular file 35 surface which is perpendicular to the surface of platform 43 is used to trim the inner sidewall rim of the wheel 22 and the inner surface of the axle head 26*a*.

Figure 11C:
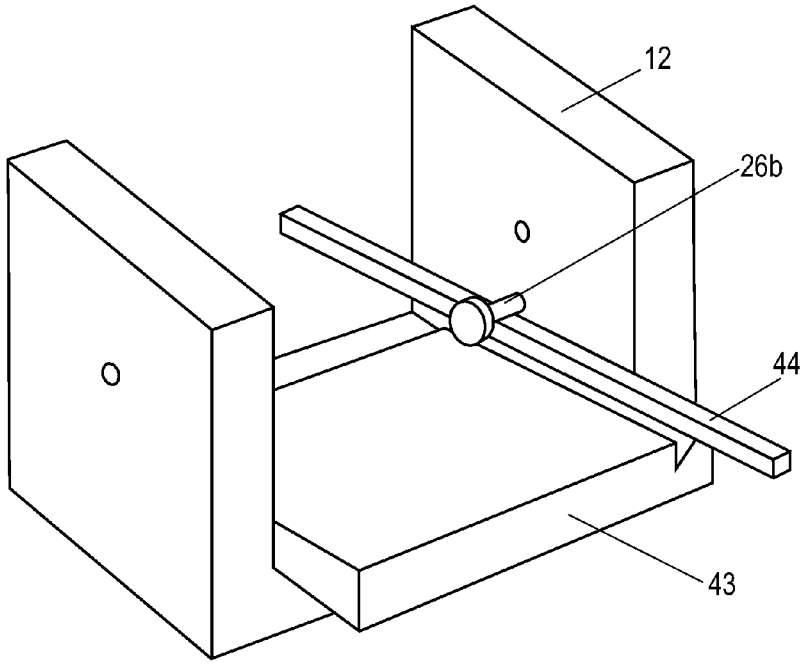
FIG. 11C is a perspective view of the workstation device showing the alternative embodiment with a square mill file engaging the wheel axle shaft.

Finally, as shown in FIG. 11C, a standard square mill file 44 positioned on the upper surface of the platform 43 against the right column 12 provides for abrasion of the wheel axle shaft 26*b* parallel to the axis of rotation.

Figure 12:
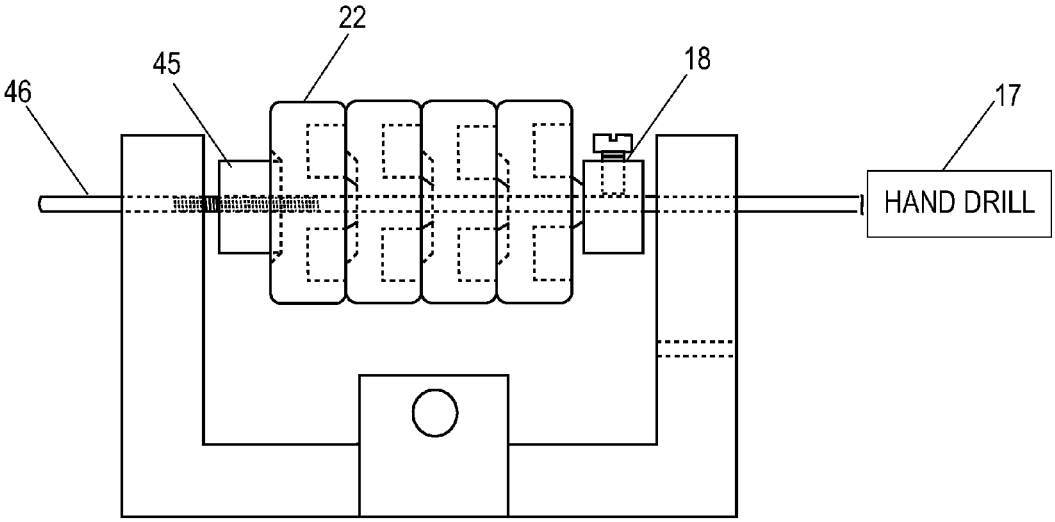
FIG. 12 shows a second alternative embodiment utilizing a threaded wheel anchor disk and threaded axle rod. The right anchor machine screw threads are not shown for clarity.

In another alternate embodiment a wheel anchor 18 which is mounted on the wheel axle rod 16 is replaced with a threaded wheel anchor disk 45, FIG. 12, of similar dimension to the previously described wheel anchor 18. This threaded wheel anchor disk self-tightens on a rotating treaded axle rod 46. The treaded axle rod 46 is comprised of a treaded surface in appropriate predetermined location to permit a threaded wheel anchor disk 45 mounted on the threaded axle rod 46 to the left of a wheel 22 to self-tighten against the mounted wheel 22. An additional wheel anchor 18 is mounted on the threaded axle rod 46 to the right of wheel 22. In a configuration with a plurality of wheels anchored in this way the left mounted threaded wheel anchor disk 45 would act to self-tighten and anchor the plurality of wheels as the threaded axle rod 46 is rotated with the urging of a hand drill. While providing a self-tightening mechanism this alternate embodiment may not be cost effective.

Operation

The Cub Scout places the work station device, FIG. 1, on a bench top or table top. A hand drill 17 is positioned to the right of the work station. Under the guidance of a parent or sponsor the hand drill 17 is held flat to the bench top or the hand drill is secured in a bench vise so that the chuck of the hand drill is horizontal. The Cub Scout then temporarily inserts the wheel axle rod 16 through hole 15 of column 12 and then through hole 14 of column 11 such that the wheel axle rod 16 now traverses the columns of the workstation. The Cub Scout then sets and levels the workstation on a book or suitable thickness of magazines so that the wheel axle rod extending to the right of column 12 can be mounted horizontally into the chuck of the hand drill. With the work station and hand drill now horizontally positioned the Cub Scout slides the wheel axle rod 16 out from the left column of the work station leaving the left end of the axle rod free to mount the wheels and the wheel anchors.

At this point, FIG. 4B, the Cub Scout first slides the free left end of the wheel axle rod 16 through the central axial hole 19 of a wheel anchor 18R. Then the Cub Scout slides a derby car wheel 22 through the wheel central axle hole 23 on to the wheel axle rod against the wheel anchor 18R with the hub 24 of the wheel facing toward the right column 12. Three more wheels are mounted in similar fashion. The Cub Scout then places a second wheel anchor 18L on the wheel axle rod and now passes the left end of the wheel axle rod through the hole 14 in the left column. The wheel axle rod is now mounted at both ends. Before locking the wheel anchors to the axle rod the Cub Scout positions the four wheels on the wheel axle rod between the columns leaving more of the wheel axle rod to the right of the right column to reach and enter the chuck of the hand drill. The Cub Scout now locks the left wheel anchor to the wheel axle rod by tightening the machine screw 21. The Cub Scout then secures the right wheel anchor in similar fashion compressing the wheels together so that the four wheels rotate as a single work piece when the hand drill is turned on. The Cub Scout now slides the workstation to the right sliding the right end of the wheel axle rod into the chuck of the hand drill. This is secured by the Cub Scout or the sponsor. The work station is now set up with the wheels in position ready to rotate to be trimmed and trued.

At this point the Cub Scout places a sheet of 200-grit wet/dry sandpaper 41 which has been glued to a thin sheet of white cardboard to fit on the entire surface of the upper platform 31, FIG. 8C. The hand drill is turned on to run at slow speed to minimize the heat transfer to the wheels during the sandpaper abrasion. The Cub Scout then turns the control knob 40, FIG. 8D, clockwise, slowly advancing the contiguous lower platform 27 and the upper platform 31 between the two columns toward the rotating wheels. The Cub Scout incrementally places finer sheets of sandpaper of 400, 600 and 1500-grit abrasion grain on the upper platform to true and fine polish the wheel treads. In this manner the Cub Scout removes wheel imperfections and produces four wheels with substantially identical wheel circumference size and identical wheel tread profiles which are flat and parallel to the axis of rotation.

Next, turning to removing imperfections from the inner sidewall of each wheel, the Cub Scout removes the four wheels from the wheel axle rod and anchors one wheel to the wheel axle rod in the fashion described above using the wheel anchors, FIG. 9A. The wheel is positioned to the left of the 60 degree groove 33 in the upper platform 31. The Cub Scout then, with the right hand, places and holds a standard triangular mill file 35 in the 60 degree groove which permits the file face to be perpendicular to the axis of subsequent wheel rotation. The wheel is slowly rotated on the axle rod with the urging of the hand drill. The Cub Scout then turns the knob 40 with the left hand to advance the upper platform with the file in position. The file is thus advanced to a level above the wheel tread surface to the inner sidewall level. The Cub Scout then slides the upper platform to the left with the left hand to allow the 90 degree surface of the file to contact the inner sidewall of the wheel, FIG. 9B. In this manner the inner sidewall of the wheel is trimmed of protrusion defects so that the entire inner wheel sidewall circumference remains at 90 degrees to the axis of rotation throughout a full rotation of the wheel. This configuration minimizes friction and wheel oscillation should the inner sidewall rim contact the track guide rail.

Next, as shown in FIG. 5A, the Cub Scout places the wheel axle 26 into the lower hole 25 in the right column 12 with the axle head 26*a* inside the column and the axle shaft 26*b* extending to the right outside the column. The Cub Scout then elevates the entire work station by adding magazines or other flat materials to horizontally position the axle shaft 26*b* into the chuck of the hand drill. This axle shaft is secured in the hand drill by the Cub Scout or the parent. The Cub Scout then places and holds a standard triangular mill file in the 60 degree groove 33 of the upper platform 31 with the right hand. The axle 26 is rotated in the column with the urging of the hand drill. The Cub Scout then turns the platform knob with the left hand to advance the upper platform and file to the wheel axle shaft level, FIG. 10A. Next, the Cub Scout slides the upper platform to the left with the left hand to allow the 90 degree surface of the file to contact the inner surface of the axle head, FIG. 10B. In this manner the so-called gusset 26*c*, FIG. 5B, a manufacturing imperfection, is trimmed away leaving the inner axle head surface polished at substantially 90 degrees to the axis of rotation. Finally, the Cub Scout removes the upper platform 31 and places a standard square mill file 44 on the upper right surface of the lower platform 27 flat against the right column 12, FIG. 10C. The file is positioned and held with the right hand. The Cub Scout then turns the platform knob 40 with the left hand to advance the platform and the file to the level of the wheel axle shaft, FIG. 10D. In this manner the burrs 26*d*, FIG. 5B, are removed as the axle shaft is polished parallel to the axis of rotation.

Operation of Alternate Embodiment

FIG. 11A depicts the embodiment with a single slidable platform 43, generally with the dimensions previously described. The platform conforms to and slides front to back between the columns of the workstation. The Cub Scout mounts a plurality of wheels, as previously described, usually four, using the left anchor 18L and right anchor 18R to secure the wheels so that they rotate as a single workpiece. In this alternate embodiment, too, the face plate 36 with threaded rod 38 and knob 40 has been removed. The Cub Scout manually advances the platform to which sandpaper has been applied in an incremental fashion to engage and trim the rotating set of wheels. In similar fashion, a single wheel is mounted and the inner sidewall rim trimmed with the triangular file 35 as the Cub Scout advances the platform and slides the entire workstation to the left.

In similar fashion, the Cub Scout slides the wheel axle 26 into the predetermined lower hole 25 of the right column 12 with the axle head inside the column, FIG. 11B. With the triangular file in the 60 degree groove the Cub Scout advances the platform and sliding the entire workstation to the left, the inner surface of the rotating axle head is engaged and trimmed. Finally, the Cub Scout places a square mill file 44 on the platform against the right column, FIG. 11C, to remove burrs 26*d* and fine tune the axle shaft.

An alternate embodiment of the wheel axle rod 16 has been described. This is depicted in FIG. 12A. In this application the Cub Scout mounts a threaded wheel anchor disk 45 on the left side of a preferentially threaded axle rod 46. This provides a self-tightening of the wheels as a single work piece between the threaded wheel anchor disk to the left and the wheel anchor 18R to the right as the threaded axle rod is rotated.

CONCLUSIONS, RAMIFICATIONS, AND SCOPE

One or more aspects of the slidable platform abrasion workstation device provide for abrasive surfaces that direct a mechanical energy toward the task of truing model car wheels and axles at specific angles to the axis of rotation. It was primarily conceived and subsequently developed to enable a Cub Scout to shape, trim and fine tune derby car wheels and axles to more effectively compete in the annual Pinewood Derby event. Traditionally, methodologies utilizing mandrels, sandpaper and files have met the basic objective of providing a unique parent/son experience toward the creation of a competitive race car. Some Cub Scouts do not have access to sophisticated machine shop equipment such as a drill press or a machine lathe. The workshop device enhances the opportunity to fine tune and true the wheels and axles, producing interactive surfaces which reduce frictional forces at sites of wheel, axle, track surface and guide rail contact. It further satisfies a compelling need to effectively enhance child participation in the preparation of derby car wheels and axles. The structured arrangement of platform surface angles to the axis of rotation of derby car wheels to reduce friction reinforces the child learning experience. The concept of surface angles may be more easily understood and assimilated.

In truing, the principal objective is to remove manufacturing defects thereby producing surface planes which are flat and smooth to minimize the friction produced as these surface planes interact. This substantially permits the wheel to run straight without wobble or vibration as it rolls down the race track. The wheel, using the traditional Cub Scout mandrel technique, is made round to the central axle hole. Similarly, wheel treads and sidewall rims are sanded to produce a flat profile. Axle head and shaft defects are removed from the metal axle using a file and then polished with fine-grit sandpaper.

The application of more sophisticated machine shop equipment to the task of specific surface preparation can substantially improve wheel and axle performance and thus the speed of the car, but it limits child participation. The workstation provides a structured support to the sandpaper and the file on specifically aligned planes to substantially true wheels and axles at 90 degrees and 180 degrees to the axis of rotation. It provides a plurality of wheels which are substantially identical in circumference and diameter. It provides a plurality of wheels with similar tread profiles, horizontal to the axis of rotation. It provides inner sidewall wheel rims with flat profiles at substantially 90 degrees to the axis of rotation throughout an entire rotation of the wheel. The width of the tread is not compromised. It provides for an axle head free of defects with an entire inner surface at substantially 90 degrees to the axle shaft. It provides for an axle shaft free of burrs, horizontal to the axis of rotation. This is a device which the Cub Scout, having limited access to a machine shop lathe or drill press, can use to equal the playing field.

I contemplate that the components of the workstation device, other than the axle rod, be made of aluminum, but other durable materials are also available, including ferrous and nonferrous metals and their alloys, plastics, polycarbonates and other durable composites. The axle rod is preferably high performance steel, but other products can be utilized.

The device has been reduced to practice. A prototype performs with accuracy using manual or hand drill urging to rotate the workpieces. Manual application is provided by securing, as described, a wheel anchor, on the axle rod to the right of the workstation housing such that a clockwise rotation of the secured anchor with thumb and index finger produces appropriate rotational urging.

The optimal dimensional relationships for the described embodiments may vary with respect to size and configuration. Variations in the shape and configuration of the planes provided by the embodiments can direct a mechanical energy to a rotating wheel, axle or other rotating workpiece, at predetermined angles.

The scope, intent, and spirit of the embodiment is to provide a structure with defined, movable planes supportive of materials which can be mechanically directed toward the task of shaping a rotating workpiece.

The reader will see that at least one embodiment provides an efficient, accurate, reliable, and economic device that can be used by a child or persons of almost any age to true model car wheels and axles.

I claim:

1. A slidable platform abrasion work station device to true model car wheels and axles, comprising:

a fixed base platform with a left column and right column forming a U-shaped housing for mounting of a slidable lower platform and a slidable upper platform, a wheel axle rod extending across and bi-mounted in said left and said right column longitudinally horizontal to said base platform and perpendicular to the inner surface of said left column and said right column, said left column and said right column with predetermined, similarly configured and positioned wheel axle rod column holes at the top mid-section to accept said wheel axle rod perpendicular to the inner surface of said left column and said right column and horizontal to said base platform, said right column having an axle hole in a predetermined size and location, horizontal to said base platform and perpendicular to the inner surface of said right column to accept said axles, said lower platform mounted on said fixed base platform, slidable between said left column and said right column, and said upper platform being a rectangular solid which is contiguously mounted on said lower platform with the upper surface longitudinally at an angle to said wheel axle rod.

2. The slidable platform abrasion work station device of claim 1 wherein said left column and said right column have similar rectangular shape and thickness, and said fixed base platform rectangular shaped.

3. The slidable platform abrasion work station device of claim 2 wherein the lower edge of said left column is mounted perpendicular to the left top surface of said fixed base platform and the lower edge of said right column is mounted perpendicular to the right top surface of said fixed base platform to form said U-shaped housing.

4. The slidable platform abrasion work station device of claim 1, further comprising said wheel axle rod with said left column and said right column accepting said wheel axle rod of predetermined diameter and a length, to be positioned through both said left column axle hole and said right column axle hole to cross between said left column and said right column longitudinally horizontal to said upper platform.

5. The slidable platform abrasion work station device of claim 4 wherein said wheel axle rod extends to the right and outside said right column to be mounted in a the chuck of a hand drill to urge rotation of said wheel axle rod.

6. The slidable platform abrasion work station device of claim 1, further comprising a wheel anchor to secure said model car wheels to said wheel axle rod in a fixed workpiece configuration wherein said wheels are rotated on said wheel axle rod through the urging of a said hand drill.

7. The slidable platform abrasion work station device of claim 6 wherein said wheel anchor is cylindrical with a central axle hole of predetermined size to accept said wheel axle rod.

8. The slidable platform abrasion work station device of claim 7 wherein said wheel anchor has a threaded hole of predetermined size extending from the outer rim to enter said central axle hole, perpendicular to said central axle hole, said threaded hole to accept a machine screw of predetermined size and length whereby clockwise rotation of said machine screw within the said wheel anchor is utilized to secure said wheel anchor to said wheel axle rod.

9. The slidable platform abrasion work station device of claim 1, further comprising said lower platform having a rectangular shape and a sloping upper surface, where the front face has a greater thickness than the back face, wherein a wedge shaped lower platform configuration is produced, with said wedge shaped lower platform being mounted on said fixed base platform slidable between said left column and said right column.

10. The slidable platform abrasion work station device of claim 9 further comprising said wedge shaped lower platform wherein a transverse groove extends longitudinally, right to left, across the said sloping upper surface in its mid portion, parallel to said front face.

11. The slidable platform abrasion work station device of claim 1, further comprising a face plate and a threaded hole of predetermined size in the center of the upper portion of said face plate, wherein the lower portion of said face plate is affixed to the mid portion of said fixed base platform such that said threaded hole is above the mid front edge of said fixed base platform.

12. The slidable platform abrasion work station device of claim 11 wherein said threaded hole of said face plate accepts a threaded rod of predetermined diameter and length, comprised of a blunt end and an opposite end with a control knob, whereby the clockwise rotation of said control knob incrementally advances said threaded rod in said face plate, whereby said lower wedge shaped platform and said upper platform are incrementally advanced.

13. The slidable platform abrasion work station device of claim 1, further comprising said upper platform, having a planar, rectangular shape, wherein a slide bar extends transversely along the under surface, in its mid portion, running longitudinally right to left and parallel to the front edge of said upper platform.

14. The slidable platform abrasion work station device of claim 13 wherein said slide bar is positioned to insert into said transverse groove of said lower wedge shaped platform thereby providing slidable mounting of the said upper platform to the top surface of said lower wedge shaped platform, maintaining the sloped configuration provided by said lower wedge shaped platform.

15. The slidable platform abrasion work station device of claim 13 wherein said slide bar provides contiguity of said upper platform to said lower wedge shaped platform such that said upper platform is slidable, front to back, within said U-shaped housing as said lower wedge shaped platform is advanced producing a directed motion toward said wheel axle rod, said slide bar also providing a lateral slidable motion horizontal to said wheel axle rod.

16. The slidable platform abrasion work station device of claim 13, further comprising a 60 degree wedge shaped groove on the right upper surface of said upper platform, extending front to back and parallel to the right edge such that the left, inner most surface of said wedge shaped groove is perpendicular to the top surface of said upper platform.

17. The slidable platform abrasion work station device of claim 1 whereby the combined structural elements of said upper platform in contiguity with said wedge shaped lower platform, sloped and longitudinally horizontal to said wheel axle rod, when incrementally advanced within said U-shaped housing provides the means for a child to direct a mechanical energy in a specific direction and motion toward the task of shaping and truing a rotating workpiece.

* * * * *